US005259316A

United States Patent [19]

Nelson et al.

[11] Patent Number: 5,259,316

[45] Date of Patent: Nov. 9, 1993

[54] METHOD AND APPARATUS FOR WET/DRY, SMALL BORE HOLE EXPLOSIVE DEVICE

[76] Inventors: James E. Nelson; Martha D. Nelson, both of 99 Sullivan Dr., Chelsea, Ala. 35043

[21] Appl. No.: 973,659

[22] Filed: Nov. 9, 1992

[51] Int. Cl.[5] ..... F42B 3/00

[52] U.S. Cl. ..... 102/312; 102/313; 102/319; 102/321; 102/323; 102/324

[58] Field of Search ..... 102/312, 313, 319, 321, 102/323, 324

[56] References Cited

U.S. PATENT DOCUMENTS

| | | | |
|---|---|---|---|
| 3,049,079 | 8/1962 | Eilo | 102/24 |
| 3,691,954 | 9/1972 | Kern | 102/318 |
| 3,696,703 | 10/1972 | Fox | 86/20.15 |
| 3,760,728 | 9/1973 | McKee et al. | 102/24 |
| 3,949,673 | 4/1976 | Lyerly | 102/24 |
| 4,380,948 | 4/1983 | Loving, Jr. et al. | 86/20.15 |
| 4,487,129 | 12/1984 | Isaac | 102/313 |
| 4,522,129 | 6/1985 | Jerberyd | 102/312 X |
| 4,787,316 | 11/1988 | Drury et al. | 102/323 |
| 4,813,358 | 3/1989 | Roberts | 102/313 |
| 4,844,167 | 7/1989 | Clark | 102/321 X |
| 4,898,066 | 2/1990 | Marz | 102/324 X |
| 5,105,743 | 4/1992 | Tano et al. | 102/312 |

*Primary Examiner*—Peter A. Nelson
*Attorney, Agent, or Firm*—Wm. Randall May

[57] ABSTRACT

A wet/dry explosive assembly for use with small diameter bore holes is disclosed. The device utilizes a small diameter watertight inner containment vessel to house a predetermined amount of blasting agent, such as ammonium nitrate with fuel oil (AN/FO). A rigid stiffener material surrounds the inner containment vessel and extends the length of an outer containment vessel. The outer containment vessel is of sufficient length and diameter to accommodate the inner containment vessel, the stiffener material and the blast detonation components necessary for proper detonation. The device is designed to accommodate bore holes of one inch (1") to three inches and one half (3.5") in diameter and up to one hundred feet (100') in length.

67 Claims, 4 Drawing Sheets

METHOD AND APPARATUS FOR WET/DRY, SMALL BORE HOLE EXPLOSIVE DEVICE

BACKGROUND OF THE INVENTION

I. FIELD OF THE INVENTION

This invention relates to wet/dry explosive packages and methods for use of same and more particularly to pre-weighed, pre-sized, explosive containment packages suitable for use with a variety of blasting agents and suitable for use in small bore holes with diameters of three and one half inches (3.5") or less.

II. PRIOR ART AND OTHER CONSIDERATIONS

The drilling of bore holes in typical blasting operations, such as road construction or strip mining, represents a substantial percentage of the total cost of such operations. Present methods and devices for these blasting operations require bore holes of at least four inches (4") in diameter and sometimes as large as six inches (6") in diameter for proper detonation and propagation of the blasting agent. One typical blasting agent in wide commercial use today is a dry blasting agent commonly known within the industry as AN/FO. AN/FO is a mixture of ammonium nitrate and fuel oil. AN/FO provides excellent performance as an explosive at a reasonable cost and excels in gas production during detonation while providing a moderately high detonation velocity. A major disadvantage of AN/FO is that it is water soluble and cannot be used unprotected in wet holes due to obvious desensitization problems. Various containment devices have been proposed for utilizing AN/FO or similar blasting agents in wet bore hole situations, however, these devices and methods have produced only marginal success and require bore hole diameters of at least four inches (4") for proper loading, detonation, firing consistency and propagation.

Blasting operations of the type described herein typically require that a number of bore holes be drilled within a calculated distance of each other with the holes being detonated or "fired" in a sequential and timed order. Water-bearing blasting agents, such as explosive emulsions, slurries or gels, have been successfully used in wet hole situations, however, these agents, used alone, have a tendency to "dead press" in small diameter, close pattern bore hole operations and have, therefore, been generally unsuitable for such operations. "Dead pressing" occurs when the oxygen-carrying glass beads contained within the water-bearing blasting agent are shattered by the shock waves from the blast of the previous sequential blast hole thereby prematurely releasing and dissipating the oxygen within the beads which tends to neutralize the explosive force within the "dead pressed" hole. Prior art explosive containment devices have been unable to eliminate or prevent the problem of dead pressing.

Additional problems with the prior art containment devices include poor cartridge-to-cartridge propagation, poor detonation, tedious loading requirements, inconsistent firing and high overall cost.

It would be expedient, therefore, for the provision of method and apparatus for the containment of water sensitive and/or water-bearing blasting agents and related components which can be effectively and efficiently used in wet or dry bore hole applications wherein the bore hole diameter is required to be no larger than three and one half inches (3.5").

In view of the foregoing, it is an object of this invention to provide method and apparatus for a wet/dry, small bore hole, explosive device which can be used effectively and efficiently in wet or dry bore holes of three and one half inches (3.5") or less diameter.

An advantage of the present invention is the provision of method and apparatus for a wet/dry, small bore hole, explosive device which assures propagation along a continuous column of explosives.

An advantage of the present invention is the provision of method and apparatus for a wet/dry, small bore hole, explosive device which will consistently fire in wet hole conditions.

Another advantage of the present invention is the provision of method and apparatus for a wet/dry, small bore hole, explosive device which has excellent detonation characteristics and efficiencies.

Another advantage of the present invention is the provision of method and apparatus for a wet/dry, small bore hole, explosive device which contains pre-weighed, pre-packaged, blasting agents for improved blast control and safety.

Yet another advantage of the present invention is the provision of method and apparatus for a wet/dry, small bore hole, explosive device which produces less fly rock, less noise and vibration and less chance for bore hole overloading.

A further advantage of the present invention is the provision of method and apparatus for a wet/dry, small bore hole, explosive device which effectively assembles one or more blasting agent(s) and blast detonation components within a single protective containment vessel.

A further advantage of the present invention is the provision of method and apparatus for a wet/dry, small bore hole, explosive device which eliminates the problem of "dead pressing" when using a water-bearing blasting agent.

A further advantage of the present invention is the provision of method and apparatus for a wet/dry, small bore hole, explosive device which substantially reduces the cost of the overall blasting operation.

SUMMARY

In accordance with embodiments of the invention, a wet/dry, small bore hole, explosive device and method comprises a pre-sized watertight outer containment vessel, a stiffener means, a watertight inner containment vessel, blasting agent(s) and blast detonation components.

The outer containment vessel is designed to slidably engage the stiffener means and the watertight inner vessel and is of sufficient length and diameter to also house the blast detonation components. The inner containment vessel is filled with a pre-weighed blasting agent, such as AN/FO, and is heat sealed at each end to ensure the vessel is water impervious.

Both outer and inner containment vessels are tubular in shape and are constructed of blown polyethylene film or similar material. The stiffener means comprises a rigid, but pliable, wrapping material such as heavy paper, light cardboard, or plastic, and is used as a liner for the interior surface of the outer containment vessel thereby creating an inner housing or hard shell for the inner containment vessel and blast detonation components.

In use, the outer containment vessel, in whatever length and diameter is required, is slidably fitted with the stiffener means and is heat sealed at its upper end in a manner which forms protruding tabs or ears for frictionally engaging the cylindrical wall of the blast hole. A pre-sized, watertight, inner containment vessel containing a pre-weighed amount of blasting agent is slidably inserted into the outer containment vessel and stiffener means. The blast detonation components are then inserted into the remaining space at the bottom of the outer containment vessel and the lower end of the vessel is thereafter securely sealed using a watertight closure means. The entire assembly is then inserted into a properly sized bore hole for detonation.

In a second embodiment, the watertight inner containment vessel is approximately ½ the diameter of the outer containment vessel and is filled with a water-bearing blasting agent such as an explosive emulsion, slurry or gel. The inner containment vessel is disposed to the center of the outer containment vessel and the space between the inner vessel and the outer vessel is filled with a dry blasting agent such as AN/FO. The outer containment vessel may or may not house the blast detonation components depending on bore hole conditions or requirements of the blast site. In this configuration, the dry blasting agent would also serve as a cushion to absorb any shock waves from prior sequential blasting thereby insulating the water-bearing blasting agent from same. As a result, the integrity of the oxygen-carrying glass beads contained within the water-bearing blasting agent is preserved.

In a third embodiment, the watertight inner containment vessel is approximately ½ the diameter of the outer containment vessel and is filled with a dry blasting agent such as AN/FO. The inner containment vessel is disposed to the center of the outer containment vessel and the space between the two vessels is filled with a water-bearing blasting agent such as an explosive emulsion, slurry or gel. The outer containment vessel may or may not house the blast detonation components depending on bore hole conditions or requirements of the blast site. In this configuration, the surrounding water-bearing blasting agent would serve to waterproof any leakage of the dry blasting agent contained within the inner containment vessel should a rupture or failure of said inner containment vessel occur. Additionally, this configuration substantially increases the explosive gas pressure of the water-bearing blasting agent thereby greatly reducing the chance of dead pressing.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
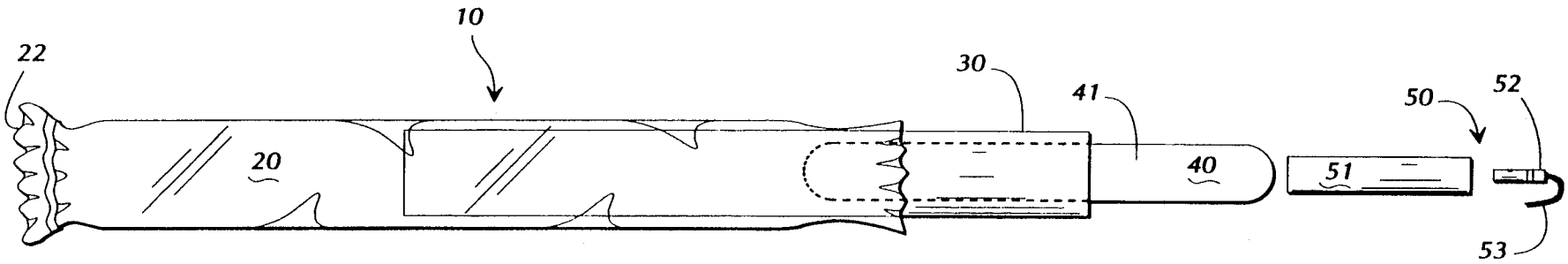
FIG. 1 is a schematic view, partially sectioned, of a wet/dry, small bore hole, explosive device shown in sequential order of insertion according to a first embodiment of the invention.
Figure 2:
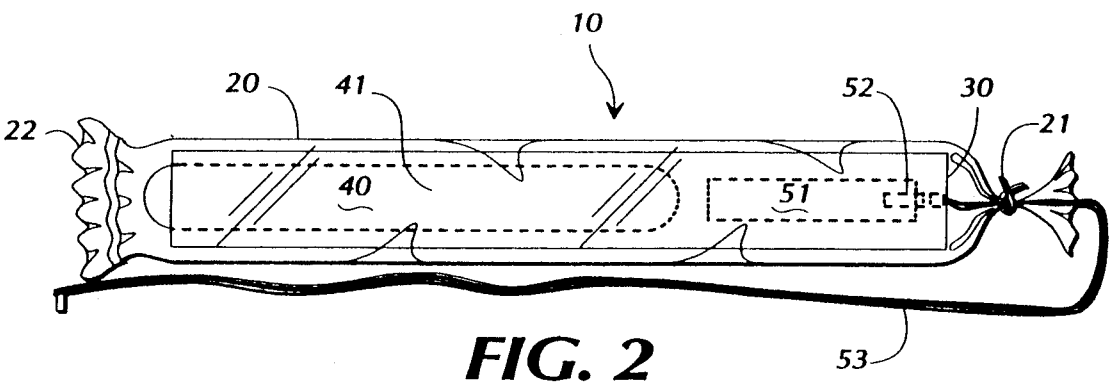
FIG. 2 is a schematic view, partially sectioned, of a the explosive device of FIG. 1 shown with all components fully assembled.

The wet/dry, small bore hole, explosive device 10 of FIG. 1 comprises a watertight outer containment vessel 20, a stiffener means 30, a watertight inner containment vessel 40 which houses blasting agent 41, and a detonation means 50.

Figure 3:
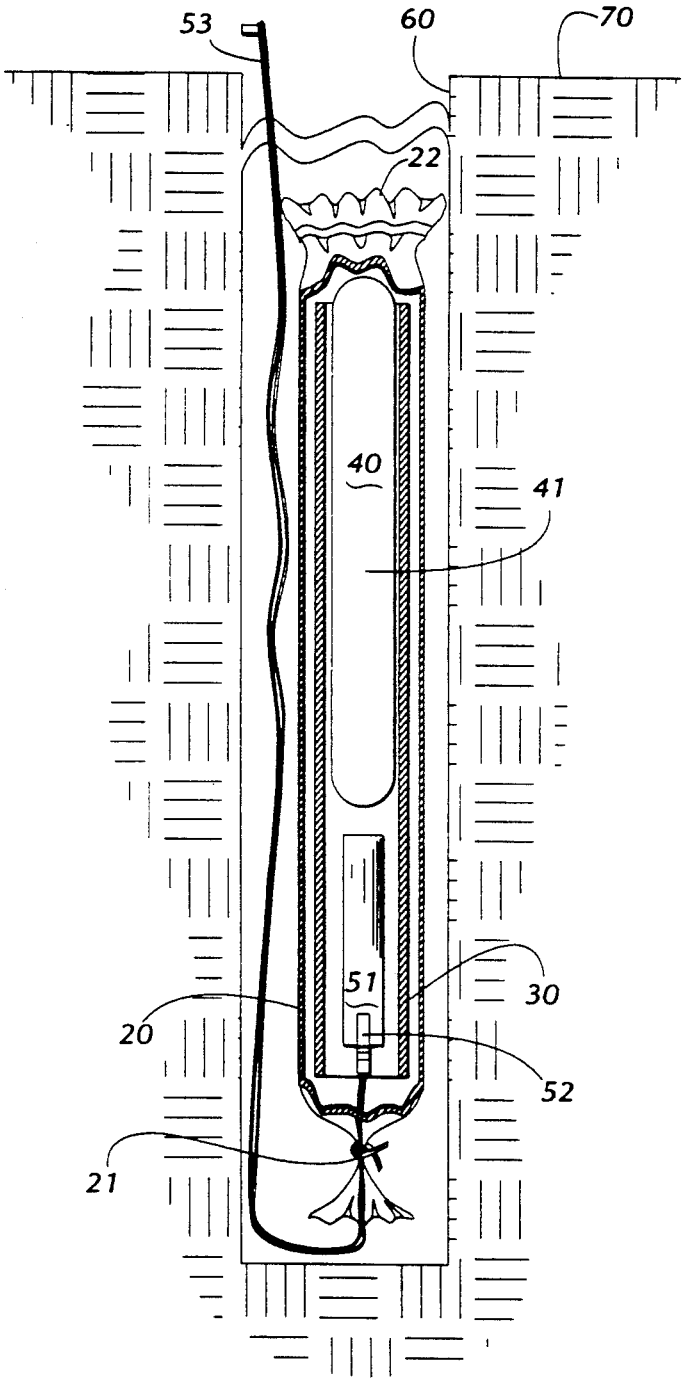
FIG. 3 is a schematic view, partially sectioned, of the explosive device of FIG. 2 shown operatively disposed within a blast bore hole.

The outer containment vessel 20 is tubular in shape and is constructed of 7 mill blown polyethylene film or other similar material of equal strength. Said outer containment vessel 20 has a diameter of three inches (3") or less and can range in length from twelve inches (12") to more than one hundred feet (100') depending on blast job requirements. The outer containment vessel 20 is designed to slidably engage the stiffener means 30, the inner containment vessel 40, and the detonation means 50. The upper end of said outer containment vessel 20 is heat sealed for watertightness in a manner which causes the formation of protruding tabs or ears 22. The tabs 22 are formed during the heat sealing process by collapsing one end of the outer containment tube cylinder 20 into a plane and applying heat perpendicularly across a section of the plane thereby causing the seam to be greater in length than the diameter of said vessel 20 thus forming said protruding tabs 22. Said tabs 22 act to frictionally engage the sides of the bore hole 60, as shown in FIG. 3, thereby inhibiting floatation of said explosive device 10 should same be disposed within a "wet" hole. Once assembled, the lower end of the outer containment vessel 20 is closed with a closure means 21 such as a tipper tie or metal clasp.

The stiffener means 30 is comprised of rigid, but pliable, material such as heavy paper, light cardboard or plastic in the form of a sleeve and when slidably engaging the outer containment vessel 20, creates an interior liner for said outer containment vessel 20 substantially covering the length of said vessel 20.

The inner containment vessel 40 is tubular in shape and is constructed of 7 mil blown polyethylene film or other similar material of equal strength. Said inner containment vessel 40 contains an amount of blasting agent 41 which has been pre-weighed and has a predetermined density commensurate with blast job requirements. The inner containment vessel 40, once filled with blasting agent 41, is heat sealed at each end to form a watertight housing for said blasting agent 41. Said inner containment vessel 40 is designed to slidably engage the interior of the outer containment vessel 20 with stiffener sleeve 30 in place.

The detonation means 50 comprises a blast primer 51, such as dynamite, and a detonator 52, such as an electric or nonel blasting cap, and detonation wires. The detonation wires 53 are operatively attached to said detonator 52 and would extend the length of the bore hole 60 to the ground surface 70 as shown in FIG. 3.

In use, the outer containment vessel 20, in whatever length and diameter is required, is heat sealed at its upper end, thereby forming protruding tabs 22. Once the upper end of said outer containment vessel 20 is properly sealed, said vessel 20 is caused to slidably engage the stiffener means 30, the inner containment vessel 40 and the detonation means 50. Once assembled, the outer containment vessel 20 is closed in a watertight manner using said closure means 21 and the entire assembly 10 is inserted into a properly sized bore hole 60 for detonation.

Figure 4:
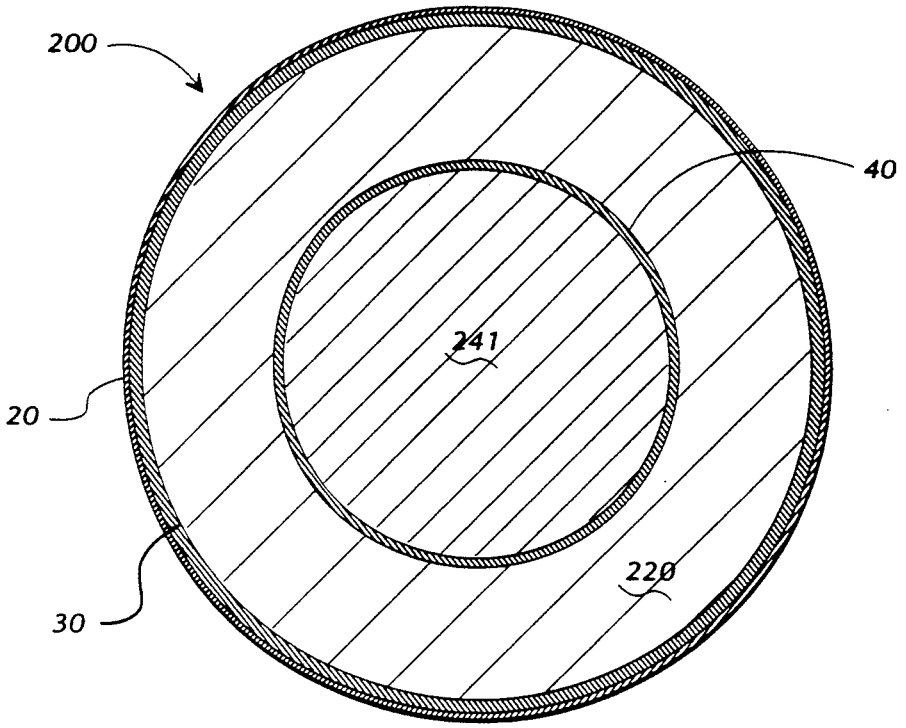
FIG. 4 is a cross-sectional top view of a wet/dry, small bore hole, explosive device according to a second embodiment of the invention.
Figure 6:
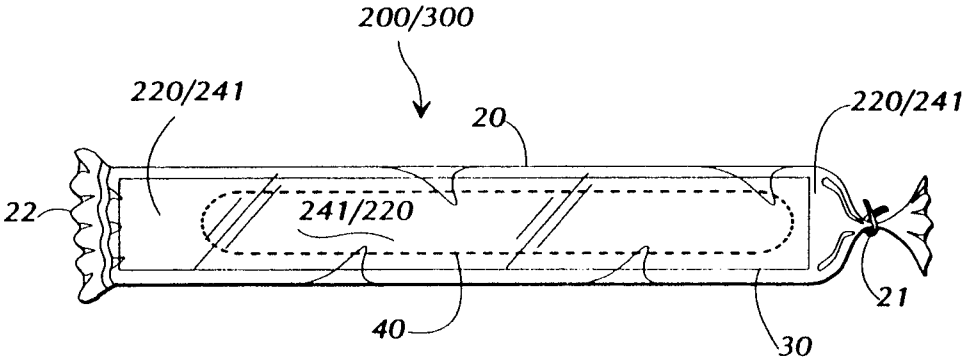
FIG. 6 is a side view of the embodiments of FIGS. 4 and 5 shown without blast detonation components within the housing of the invention.
Figure 7:
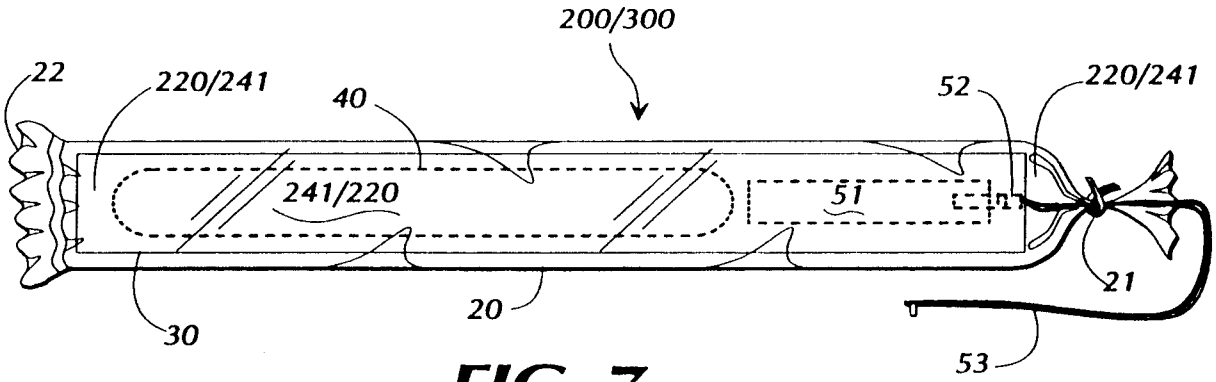
FIG. 7 is a side view of the embodiments of FIGS. 4 and 5 shown with blast detonation components disposed within the housing of the invention.

The wet/dry, small bore hole, explosive device 200 of a second preferred embodiment shown in FIGS. 4, 6 and 7 is similar in many respects to the explosive device of FIG. 1. The structural elements or components of the explosive device 200 of the embodiment of FIGS. 4, 6 and 7 are essentially the same as those provided in the explosive device of the embodiment of FIG. 1, with those common elements being referred to by the same reference numerals for both embodiments.

The explosive device 200 of the embodiment of FIGS. 4, 6 and 7 differs from the device 10 of FIG. 1 in that the inner containment vessel 40 is downsized to approximately ½ the diameter of the outer containment vessel 20 and is filled with a water-bearing blasting agent 241 such as an explosive emulsion, slurry or gel. The inner containment vessel 40 is disposed centrally within the outer containment vessel 20 and the space created between said inner containment vessel 40 and said outer containment vessel 20 is filled with a dry blasting agent 220 such as AN/FO or other similar blasting agent. A blast detonation means 50 may or may not be disposed within the housing of the outer containment vessel 20 depending on bore hole 60 conditions or conditions of the blast site.

Figure 5:
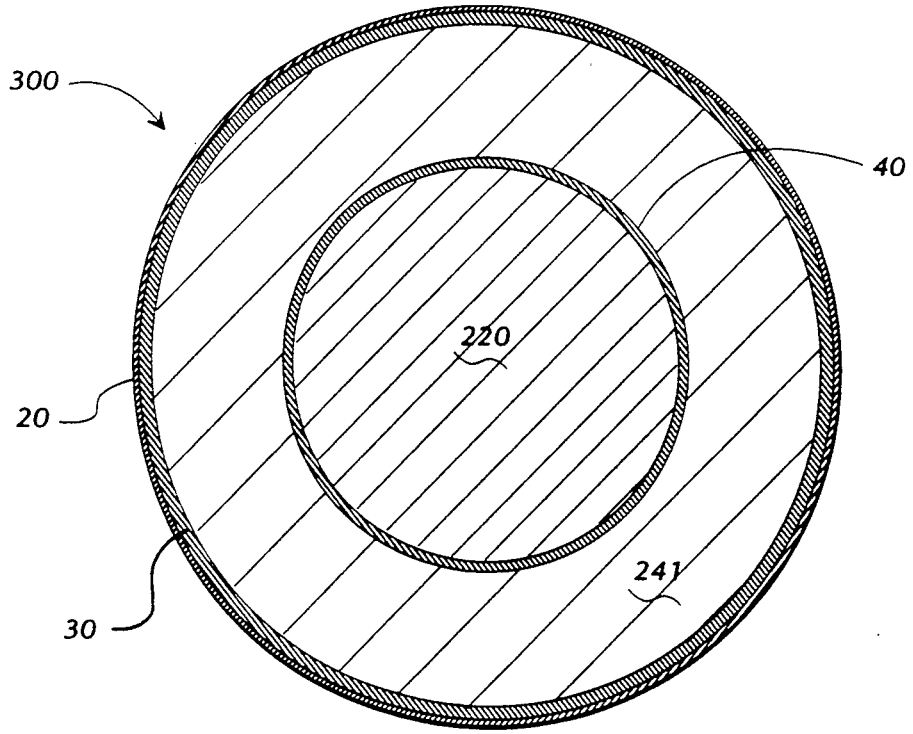
FIG. 5 is a cross-sectional top view of wet/dry, small bore hole, explosive device according to a third embodiment of the invention.

The wet/dry, small bore hole, explosive device 300 of a third preferred embodiment of FIGS. 5, 6 and 7 is similar in many respects to the explosive device of FIG. 1. The structural elements or components of the explosive device 300 of the embodiment of FIGS. 5, 6 and 7 are essentially the same as those provided in the explosive device of the embodiment of FIG. 1, with those common elements being referred to by the same reference numerals for both embodiments.

The explosive device 300 of the embodiment of FIGS. 5, 6 and 7 differs from the device 10 of FIG. 1 in that the inner containment vessel 40 is downsized to approximately ½ the diameter of the outer containment vessel 20 and is filled with a dry blasting agent 220 such as AN/FO or other similar blasting agent. The inner containment vessel 40 is disposed centrally within the outer containment vessel 20 and the space created between said inner containment vessel 40 and said outer containment vessel 20 is filled with a water-bearing blasting agent 241 such as an explosive emulsion, slurry or gel. A blast detonation means 50 may or may not be disposed within the housing of the outer containment vessel 20 depending or bore hole 60 conditions or conditions of the blast site.

The embodiments of the invention in which an exclusive property or privilege is claimed are defined as follows:

1. A wet/dry, small bore hole, explosive apparatus comprising:

a water impervious, tubular, outer containment vessel;

a stiffener means slidably disposed within the interior of said outer containment vessel;

a watertight, tubular, inner containment vessel for housing a blasting agent, said vessel being slidably disposed within the interior of said outer containment vessel and said stiffener means; and, a detonation means substantially disposed within the interior of said outer containment vessel and said stiffener means.

2. The apparatus of claim 1, wherein said outer containment vessel and said inner containment vessel are constructed of polyethylene film or similar material.

3. The apparatus of claim 1, wherein at least one end of said outer containment vessel is heat sealed.

4. The apparatus of claim 1, wherein at least one end of said outer containment vessel further comprises protruding tabs or ears which extend beyond the diameter of said vessel.

5. The apparatus of claim 1, wherein the diameter of said outer containment vessel is three and one half inches (3.5") or less.

6. The apparatus of claim 1, wherein said stiffener means comprises a rigid, but pliable, sleeve extending substantially the length of said outer containment vessel.

7. The apparatus of claim 1, wherein said inner containment vessel is comprised of polyethylene film or similar material.

8. The apparatus of claim 1, wherein said inner containment vessel is heat sealed at both ends to ensure vessel is impervious to moisture.

9. The apparatus of claim 1, wherein said inner containment vessel contains a pre-measured, pre-weighed amount of blasting agent.

10. The apparatus of claim 1, wherein said detonation means comprises a blast primer, a detonator and detonation wires.

11. A wet/dry, small bore hole, explosive apparatus comprising:

a watertight, tubular, outer containment vessel partially filled with a dry blasting agent;

a stiffener means slidably disposed within the interior of said outer containment vessel;

a watertight, inner containment vessel for housing a waterbearing blasting agent, said inner containment vessel being centrally disposed within the interior of said outer containment vessel and said stiffener means, with said inner containment vessel being surrounded by said dry blasting agent; and, a detonation means.

12. A wet/dry, small bore hole, explosive apparatus comprising:

a water impervious, tubular, outer containment vessel partially filled with a water-bearing blasting agent;

a stiffener means slidably disposed within the interior of said outer containment vessel;

a water impervious, inner containment vessel for housing a dry blasting agent, said inner containment vessel being centrally disposed within the interior of said outer containment vessel and said stiffener means, with said inner containment vessel being surrounded by said water-bearing blasting agent; and, a detonation means.

13. The apparatus of claim 11, wherein said outer containment vessel and said inner containment vessel are constructed of polyethylene film or similar material.

14. The apparatus of claim 11, wherein said outer containment vessel is heat sealed at both ends to ensure vessel is impervious to water.

15. The apparatus of claim 11, wherein at least one end of said outer containment vessel further comprises protruding tabs or ears which extend beyond the diameter of said vessel.

16. The apparatus of claim 11, wherein the diameter of said outer containment vessel is three and one half inches (3.5") or less.

17. The apparatus of claim 11, wherein said stiffener means comprises a rigid, but pliable, sleeve extending substantially the length of said outer containment vessel.

18. The apparatus of claim 11, wherein said inner containment vessel is heat sealed at each end to ensure said vessel is impervious to moisture.

19. The apparatus of claim 11, wherein said inner containment vessel is approximately one half (½) the diameter of said outer containment vessel.

20. The apparatus of claim 11, wherein said inner containment vessel contains a pre-measured, preweighed amount of water-bearing blasting agent.

21. The apparatus of claim 11, wherein said outer containment vessel contains a pre-measured, preweighed amount of dry blasting agent.

22. The apparatus of claim 11, wherein said detonation means comprises a blast primer, a detonator and detonation wires.

23. The apparatus of claim 11, wherein said detonation means is substantially disposed within the interior of said outer containment vessel and said stiffener means.

24. The apparatus of claim 12, wherein said watertight outer containment vessel and said inner containment vessel are constructed of polyethylene film or similar material.

25. The apparatus of claim 12, wherein said outer containment vessel is heat sealed at both ends to ensure vessel is impervious to water.

26. The apparatus of claim 12, wherein at least one end of said outer containment vessel further comprises protruding tabs or ears which extend beyond the diameter of said vessel.

27. The apparatus of claim 12, wherein the diameter of said outer containment vessel is three and one half inches (3.5") or less.

28. The apparatus of claim 12, wherein said stiffener means comprises a rigid, but pliable, sleeve extending substantially the length of said outer containment vessel.

29. The apparatus of claim 12, wherein said inner containment vessel is heat sealed at both ends to ensure vessel is impervious to water.

30. The apparatus of claim 12, wherein said inner containment vessel is approximately one half (½) the diameter of said outer containment vessel.

31. The apparatus of claim 12, wherein said inner containment vessel contains a pre-measured, preweighed amount of dry blasting agent.

32. The apparatus of claim 12, wherein said outer containment vessel contains a pre-measured, preweighed amount of water-bearing blasting agent.

33. The apparatus of claim 12, wherein said detonation means comprises a blast primer, a detonator and detonation wires.

34. The apparatus of claim 12, wherein said detonation means is substantially disposed within the interior of said outer containment vessel and said stiffener means.

35. A method for producing and exploding a wet/dry, small bore hole, explosive apparatus, comprising the steps of:

sealing one end of a tubular first containment vessel so that said end is water impervious;

sliding a stiffener means into said first containment vessel;

filling a second containment vessel with a blasting agent;

sealing said second containment vessel so that said second vessel is watertight;

sliding said second containment vessel into said first containment vessel so that said stiffener means is exterior to said second containment vessel;

sliding a detonation means into said first containment vessel so that said stiffener means is exterior to said detonation means;

sealing the open end of said first containment vessel so that said end is substantially watertight;

placing said apparatus into a small bore hole; and, detonating said apparatus.

36. The method of claim 35, wherein said first containment vessel and said second containment vessel are constructed of polyethylene film or similar material.

37. The method of claim 35, wherein at least one end of said first containment vessel is heat sealed.

38. The method of claim 35, wherein at least one end of said first containment vessel has protruding tabs or ears which extend beyond the diameter of said first containment vessel.

39. The method of claim 35, wherein said diameter of said first containment vessel is three and one half inches (3.5") or less.

40. The method of claim 35, wherein said stiffener means comprises a rigid, but pliable, sleeve extending substantially the length of said first containment vessel.

41. The method of claim 35, wherein said second containment vessel is heat sealed at each end to ensure said vessel is impervious to moisture.

42. The method of claim 35, wherein said second containment vessel contains a pre-measured, preweighed amount of blasting agent.

43. The method of claim 35, wherein said detonation means comprises a blast primer, a detonator and detonation wires.

44. A method for producing and exploding a wet/dry, small bore hole, explosive apparatus, comprising the steps of:

sealing one end of a tubular first containment vessel so that said end is water impervious;

sliding a stiffener means into said first containment vessel;

partially filling said first containment vessel with a dry blasting agent;

filling a second containment vessel with a water-bearing blasting agent;

sealing said second containment vessel so that said second containment vessel is water impervious;

inserting said second containment vessel into said first containment vessel and holding said second containment vessel essentially in the center of said first containment vessel while filling the remainder of said first containment vessel with dry blasting agent;

sealing the open end of said first containment vessel so that said end is water impervious;

placing said apparatus into a small bore hole containing a detonation means; and, detonating said apparatus.

45. The method of claim 44, wherein said first containment vessel and said second containment vessel are constructed of polyethylene film or similar material.

46. The method of claim 44, wherein said second containment vessel is tubular in shape and is approximately one half (½) the diameter of said first containment vessel.

47. The method of claim 44, wherein at least one end of said first containment vessel is heat sealed.

48. The method of claim 44, wherein at least one end of said first containment vessel has protruding tabs or ears which extend beyond the diameter of said first containment vessel.

49. The method of claim 44, wherein the diameter of said first containment vessel is three and one half inches (3.5") or less.

50. The method of claim 44, wherein said stiffener means comprises a rigid, but pliable, sleeve extending substantially the length of said first containment vessel.

51. The method of claim 44, wherein said second containment vessel is heat sealed at each end.

52. The method of claim 44, wherein said first containment vessel contains a pre-measured, pre-weighed amount of dry blasting agent.

53. The method of claim 44, wherein said second containment vessel contains a pre-measured, pre-weighed amount of water-bearing blasting agent.

54. The method of claim 44, wherein said detonation means comprises a blast primer, a detonator and detonation wires.

55. The method of claim 44, wherein said detonation means is contained substantially within said first containment vessel.

56. A method for producing and exploding a wet/dry, small bore hole, explosive apparatus, comprising the steps of:

sealing one end of a tubular first containment vessel so that said end is water impervious;

sliding a stiffener means into said first containment vessel;

partially filling said first containment vessel with water-bearing blasting agent;

filling a second containment vessel with a dry blasting agent;

sealing said second containment vessel so that said second containment vessel is water impervious;

inserting said second containment vessel into said first containment vessel and holding said second containment vessel essentially in the center of said first containment vessel while filling the remainder of said first containment vessel with water-bearing blasting agent;

sealing the open end of said first containment vessel so that said end is water impervious;

placing said apparatus into a small bore hole containing a detonation means; and, detonating said apparatus.

57. The method of claim 56, wherein said first containment vessel and said second containment vessel are constructed of polyethylene film or similar material.

58. The method of claim 56, wherein said second containment vessel is tubular in shape and is approximately one half (½) the diameter of said first containment vessel.

59. The method of claim 56, wherein at least one end of said first containment vessel is heat sealed.

60. The method of claim 56, wherein at least one end of said first containment vessel has protruding tabs or ears which extend beyond the diameter of said first containment vessel.

61. The method of claim 56, wherein the diameter of said first containment vessel is three and one half inches (3.5") or less.

62. The method of claim 56, wherein said stiffener means comprises a rigid, but pliable, sleeve extending substantially the length of said first containment vessel.

63. The method of claim 56, wherein said second containment vessel is heat sealed at each end.

64. The method of claim 56, wherein said first containment vessel contains a pre-measured, pre-weighed amount of water-bearing blasting agent.

65. The method of claim 56, wherein said second containment vessel contains a pre-measured, pre-weighed amount of dry blasting agent.

66. The method of claim 56, wherein said detonation means comprises a blast primer, a detonator and detonation wires.

67. The method of claim 56, wherein said detonation means is contained substantially within said first containment vessel.

* * * * *